US006390347B1

(12) United States Patent
Phillips

(10) Patent No.: US 6,390,347 B1
(45) Date of Patent: May 21, 2002

(54) IN-LINE SKATE CARRIER

(76) Inventor: Marcus Phillips, P.O. Box 10402, Beverly Hills, CA (US) 90213

( * ) Notice: Subject to any disclaimer, the term of this patent is extended or adjusted under 35 U.S.C. 154(b) by 0 days.

(21) Appl. No.: 09/534,486

(22) Filed: Mar. 24, 2000

(51) Int. Cl.[7] ..... A45F 3/02

(52) U.S. Cl. ..... 224/611; 224/607; 224/609; 224/614; 294/146; D3/261

(58) Field of Search ..... 224/611, 191, 224/603, 607, 609, 614, 616, 617; 294/146, 149, 150, 151, 154, 156, 159, 162, 163, 165; D3/261

(56) References Cited

U.S. PATENT DOCUMENTS

| | | | | | |
|---|---|---|---|---|---|
| 4,269,337 | A | * | 5/1981 | Sobotka | 224/611 X |
| 4,976,388 | A | | 12/1990 | Coontz | |
| D328,186 | S | | 7/1992 | Hanke | |
| D335,576 | S | | 5/1993 | Phillpott | |
| 5,388,743 | A | | 2/1995 | Silagy | |
| 5,411,194 | A | | 5/1995 | Nagasawa et al. | |
| 5,437,401 | A | | 8/1995 | Seltzer | |
| D368,585 | S | * | 4/1996 | Garcia et al. | 224/611 X |
| 5,617,983 | A | * | 4/1997 | Lindauer et al. | 224/433 X |
| 5,664,719 | A | * | 9/1997 | Bigham et al. | 294/143 X |
| 5,709,425 | A | * | 1/1998 | Cordova | 294/162 |
| 5,788,305 | A | * | 8/1998 | Hung | 294/162 X |

* cited by examiner

*Primary Examiner*—Stephen K. Cronin
*Assistant Examiner*—Maerena W. Brevard

(57) ABSTRACT

An in-line skate carrier is provided including a rack having a plurality of recesses formed therein along a length thereof. Also included is a carrying assembly mounted on the rack for carrying the same. Next provided is a securement assembly coupled to the rack for encompassing a pair of in-line skates and securing the same to the rack with the wheels of the skates situated within the recesses.

7 Claims, 3 Drawing Sheets

IN-LINE SKATE CARRIER

BACKGROUND OF THE INVENTION

1. Field of the Invention

The present invention relates to carrying straps and more particularly pertains to a new in-line skate carrier for carrying a pair of in-line skates in a secure, convenient manner.

2. Description of the Prior Art

The use of carrying straps is known in the prior art. More specifically, carrying straps heretofore devised and utilized are known to consist basically of familiar, expected and obvious structural configurations, notwithstanding the myriad of designs encompassed by the crowded prior art which have been developed for the fulfillment of countless objectives and requirements.

Known prior art carrying straps include U.S. Pat. No. Des. 335,576; U.S. Pat. No. 4,976,388; U.S. Pat. No. 5,411,194; U.S. Pat. No. 5,437,401; U.S. Pat. No. 5,388,743; and U.S. Pat. No. Des. 328,186.

In these respects, the in-line skate carrier according to the present invention substantially departs from the conventional concepts and designs of the prior art, and in so doing provides an apparatus primarily developed for the purpose of carrying a pair of in-line skates in a secure, convenient manner.

SUMMARY OF THE INVENTION

In view of the foregoing disadvantages inherent in the known types of carrying straps now present in the prior art, the present invention provides a new in-line skate carrier construction wherein the same can be utilized for carrying a pair of in-line skates in a secure, convenient manner.

The general purpose of the present invention, which will be described subsequently in greater detail, is to provide a new in-line skate carrier apparatus and method which has many of the advantages of the carrying straps mentioned heretofore and many novel features that result in a new in-line skate carrier which is not anticipated, rendered obvious, suggested, or even implied by any of the prior art carrying straps, either alone or in any combination thereof.

To attain this, the present invention generally comprises a rack taking the form of a rectilinear block with a first elongated face, a second elongated face and a peripheral wall formed therebetween. Such peripheral wall is defined by a pair of elongated side walls and a pair of short end walls, as shown in FIG. 1. The first elongated face of the block of the rack has a plurality of equally spaced U-shaped recesses formed therein along a length thereof. Each recess is confined by the side walls. Such side walls have an upper edge with a plurality of square cut out pairs formed therein. Each pair of square cut outs are positioned about an axis associated with one of the U-shaped recesses for reasons that will soon become apparent. The rack further has a pair of slits formed between the side walls. The slits are formed adjacent to opposite end walls and further adjacent to the second elongated face of the block of the rack. FIG. 1 includes a U-shaped handle having a pair of ends coupled to a central extent of the second elongated face of the block of the rack. It should be noted that the U-shaped handle is rigid and remains in coplanar relationship with the block of the rack. Associated therewith is a shoulder strap assembly including a pair of pins each coupled to a separate one of the end walls of the block of the rack. Each pin terminates with an enlarged disk-shaped head. The shoulder strap assembly further includes a flexible shoulder harness with a planar rectangular configuration. A pad is mounted on a central portion of the shoulder harness. Further, a pair of slits are formed at ends of the shoulder harness for being removably coupled to the pins. FIG. 1 depicts a pair of flexible straps each with a planar rectangular configuration. A width of each flexible strap is equal to about ¼ that of the block of the rack. As shown in FIG. 4, each strap includes a pouch mounted on a central portion thereof. Further, fasteners are coupled along short end edges of each strap.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new in-line skate carrier apparatus and method which has many of the advantages of the carrying straps mentioned heretofore and many novel features that result in a new in-line skate carrier which is not anticipated, rendered obvious, suggested, or even implied by any of the prior art carrying straps, either alone or in any combination thereof.

It is another object of the present invention to provide a new in-line skate carrier which may be easily and efficiently manufactured and marketed.

It is a further object of the present invention to provide a new in-line skate carrier which is of a durable and reliable construction.

An even further object of the present invention is to provide a new in-line skate carrier which is susceptible of a low cost of manufacture with regard to both materials and labor, and which accordingly is then susceptible of low prices of sale to the consuming public, thereby making such in-line skate carrier economically available to the buying public.

Still yet another object of the present invention is to provide a new in-line skate carrier which provides in the apparatuses and methods of the prior art some of the advantages thereof, while simultaneously overcoming some of the disadvantages normally associated therewith.

Still another object of the present invention is to provide a new in-line skate carrier for carrying a pair of in-line skates in a secure, convenient manner.

Even still another object of the present invention is to provide a new in-line skate carrier that includes a rack having a plurality of recesses formed therein along a length thereof. Also included is a carrying assembly mounted on the rack for carrying the same. Next provided is a securement assembly coupled to the rack for encompassing a pair of in-line skates and securing the same to the rack with the wheels of the skates situated within the recesses.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
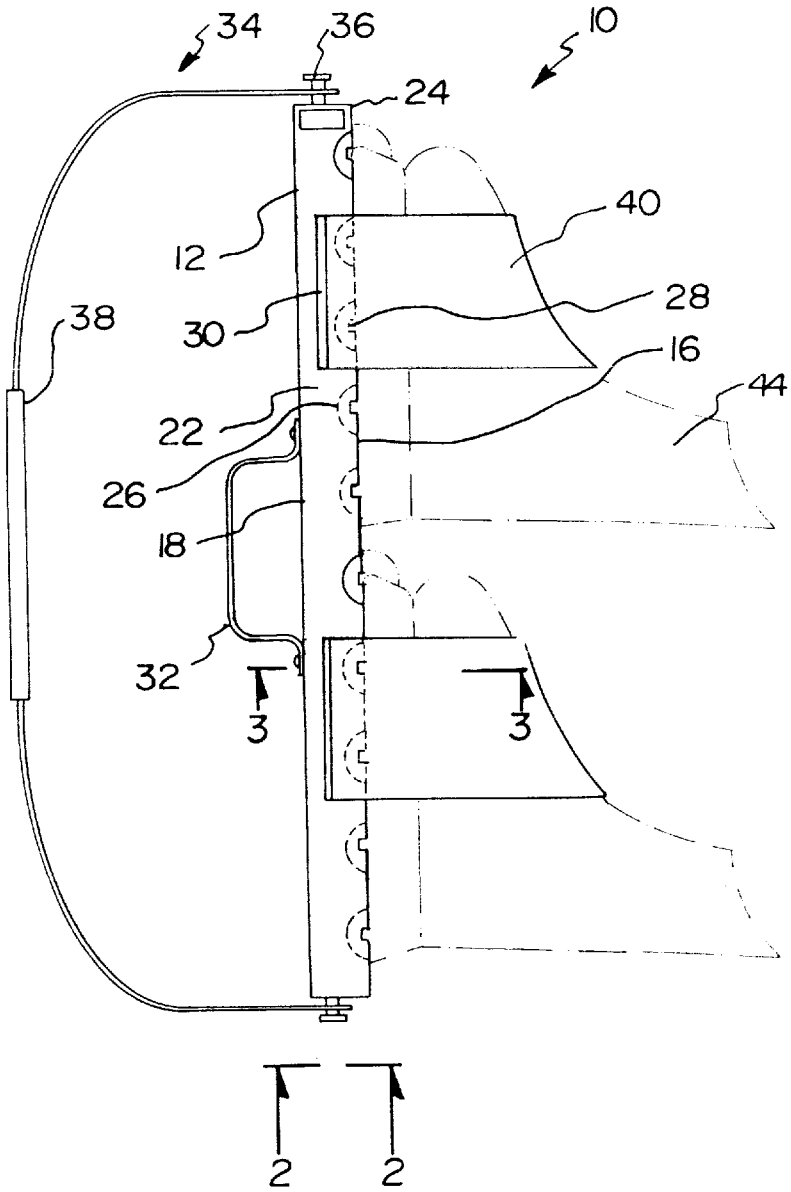
FIG. 1 is a side view of a new in-line skate carrier according to the present invention.
Figure 2:
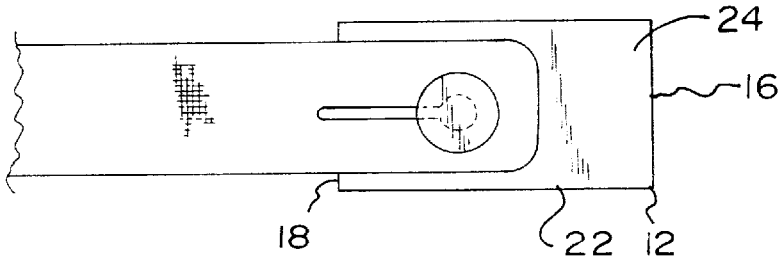
FIG. 2 is an end view of the present invention showing the shoulder harness assembly.
Figure 3:
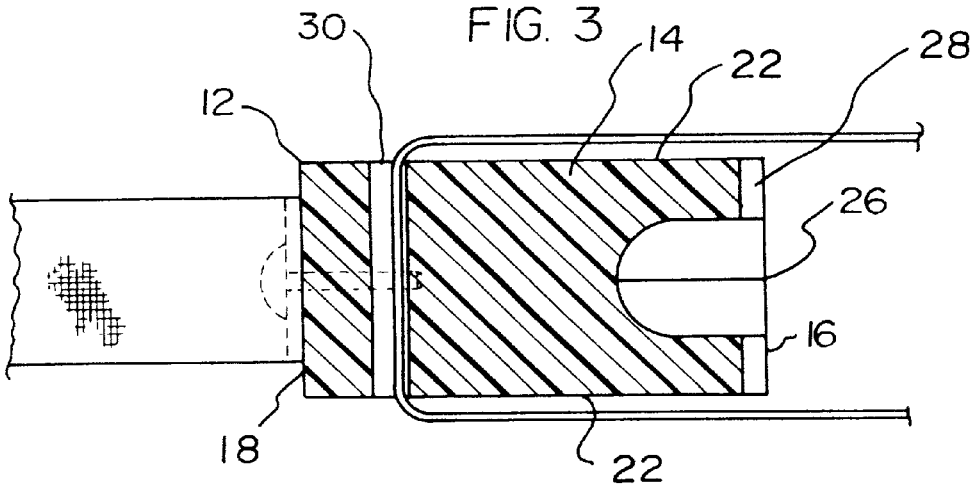
FIG. 3 is an end cross-sectional view of the present invention taken along line 3—3 shown in FIG. 1.

With reference now to the drawings, and in particular to FIGS. 1 through 6 thereof, a new in-line skate carrier embodying the principles and concepts of the present invention and generally designated by the reference numeral 10 will be described.

The present invention, designated as numeral 10, includes a rack 12 taking the form of a rectilinear metal or plastic block 14 with a first elongated face 16, a second elongated face 18 and a peripheral wall 20 formed therebetween. Such peripheral wall is defined by a pair of elongated side walls 22 and a pair of short end walls 24, as shown in FIG. 1.

The first elongated face of the block of the rack has a plurality of equally spaced U-shaped recesses 26 formed therein along a length thereof. Each recess is confined by the side walls. Such side walls have an upper edge with a plurality of square cut out pairs 28 formed therein. Each pair of square cut outs are positioned about an axis associated with one of the U-shaped recesses for reasons that will soon become apparent. The rack further has a pair of slits 30 formed between the side walls. The slits are formed adjacent to opposite end walls and further adjacent to the second elongated face of the block of the rack.

FIG. 1 shows a U-shaped handle 32 having a pair of ends coupled to a central extent of the second elongated face of the block of the rack. It should be noted that the U-shaped handle is rigid and remains in coplanar relationship with the block of the rack.

Associated therewith is a shoulder strap assembly 34 including a pair of pins 36 each coupled to a separate one of the end walls of the block of the rack. Each pin terminates with an enlarged disk-shaped head. The shoulder strap assembly further includes a flexible shoulder harness with a planar rectangular configuration. A pad 38 is mounted on a central portion of the shoulder harness. Further, a pair of linear slits are formed at ends of the shoulder harness for being removably coupled to the pins. Note FIG. 2.

Figure 4:
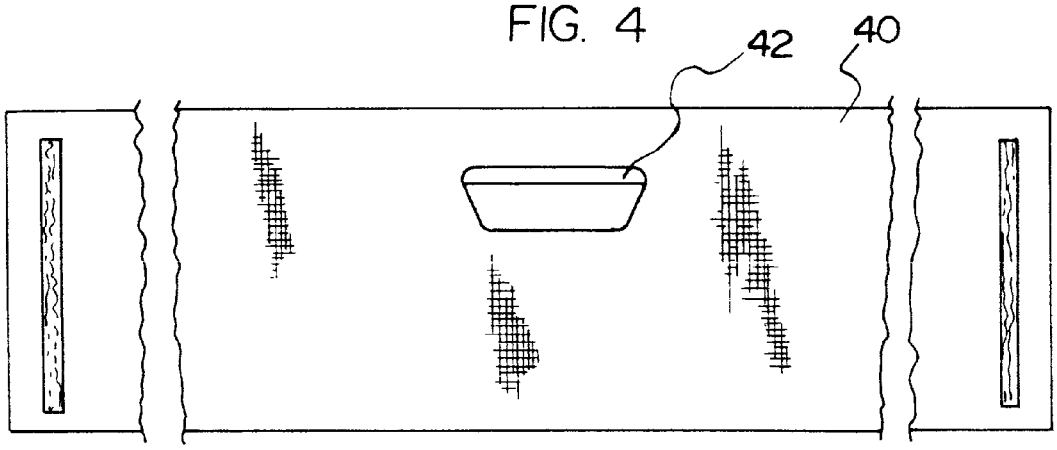
FIG. 4 is a bottom view of one of the straps of the securement assembly of the present invention.

FIG. 1 depicts a pair of flexible straps 40 each with a planar rectangular configuration. A width of each flexible strap is equal to about ¼ that of the block of the rack. As shown in FIG. 4, each strap includes a pouch 42 mounted on a central portion thereof. Such pouch is constructed from a flexible material similar to that from which the straps are constructed. Further, the pouch is preferably equipped with a lid. Fasteners are coupled along short end edges of each strap. Such fasteners may take on any form including, but not limited to snap fasteners, pile fasteners, buttons or the like.

Figure 5:
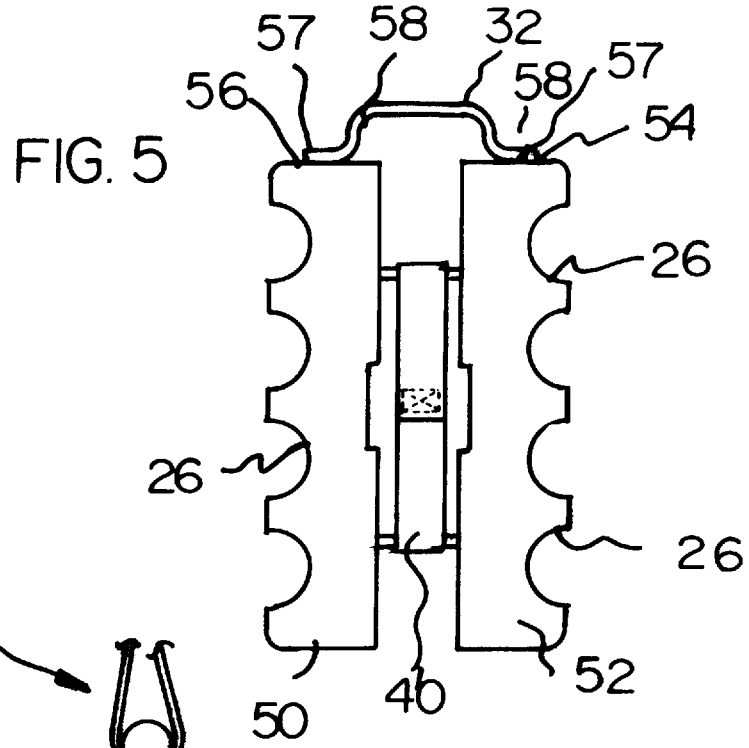
FIG. 5 is an elevational view of an embodiment of the present invention.
Figure 6:
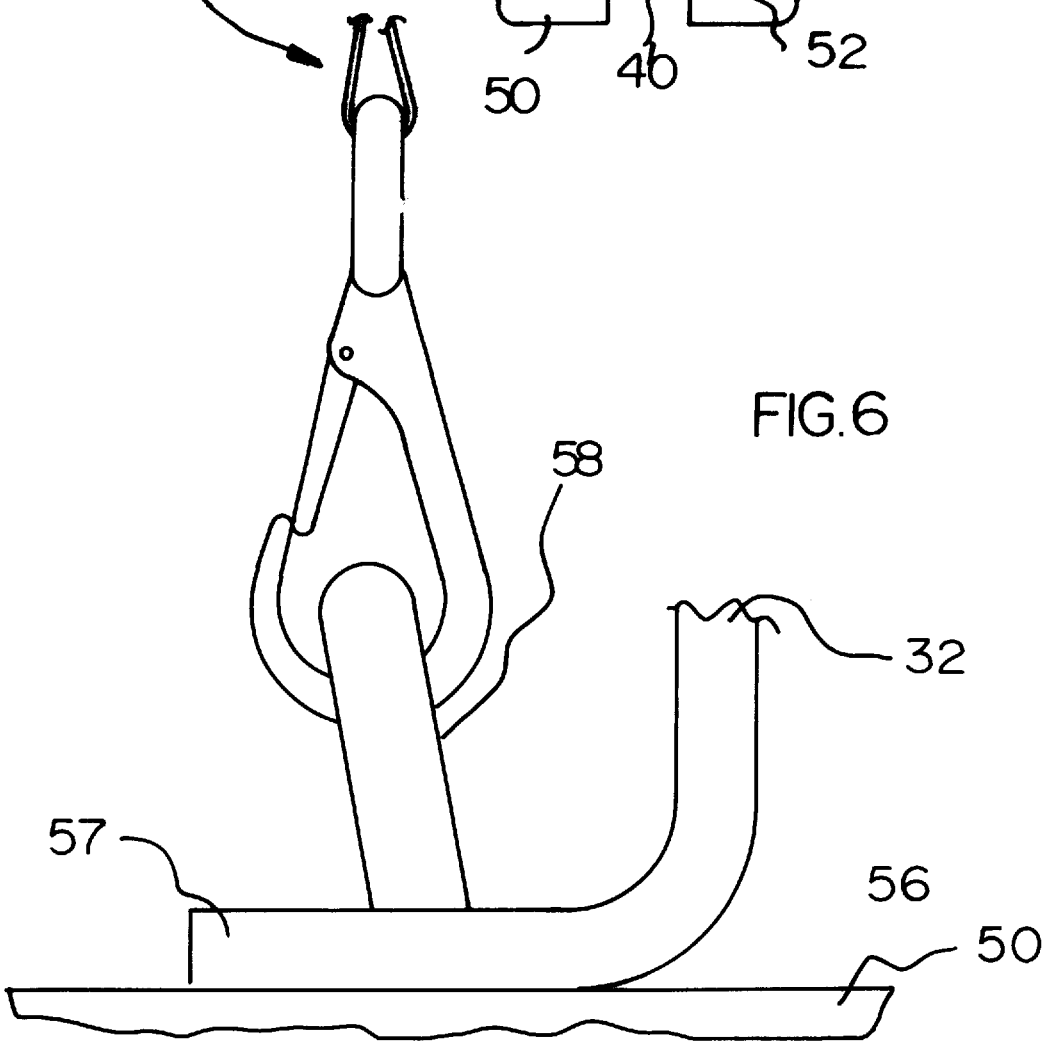
FIG. 6 is an enlarged view of the clasp ring of the embodiment of the present invention.

As shown in FIG. 5, an embodiment has a second rack 50 being coupled to a first rack 52 such that the recesses of the first rack are diametrically opposed to the recesses of the second rack. A carrying assembly includes a handle coupled between an upper end 54 of the first rack and an upper end 56 of the second rack. The handle has a pair of mounting ends 57. Each of the mounting ends having a clasp ring 58 for receiving an end of the shoulder strap assembly such the first and second racks can be carried over the shoulder of a user. Each first and second rack has a rectangular channel on a rear side thereof for the flexible straps to lie in for preventing the flexible straps from sliding along a length of the rack.

In use, wheels of a pair of in-line skates 44 may be situated within the recesses of the block of the rack. Thereafter, the straps may be slidably situated within the slits of the block of the rack and the fasteners of the straps coupled in order to secure the in-line skates to the rack. As such, the rack and skates may be totted by either the handle or the shoulder strap assembly.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An in-line skate carrier comprising:

a first rack including a plurality of recesses formed therein along a length thereof;

a carrying assembly mounted on the rack for carrying the rack;

a securement assembly coupled to the rack for encompassing a pair of in-line skates and securing the same to the rack with the wheels of the skates situated within the recesses; and a second rack being coupled to the first rack such that the recesses of the first rack open in an opposite direction with respect to the recesses of the second rack.

2. An in-line skate carrier as set forth in claim 1 wherein the recesses are substantially U-shaped.

3. An in-line skate carrier as set forth in claim 1 wherein the securement assembly includes a flexible strap.

4. An in-line skate carrier as set forth in claim 1 wherein the carrying assembly comprises a handle coupled between an upper end of the first rack and an upper end of the second rack.

5. An in-line skate carrier as set forth in claim 4 wherein the handle has a pair of mounting ends, each of the mounting ends having a clasp ring.

6. An in-line skate carrier as set forth in claim 5 wherein the carrying assembly includes a shoulder harness removably coupled to the clasp rings.

7. An in-line skate carrier comprising:

a pair of racks, each of the racks having a plurality of recesses formed therein along a length thereof, the racks being mounted together such that the recesses of a first one of the racks open in an opposite direction with respect to the recesses of a second one of the racks, the recesses being substantially U-shaped;

a carrying assembly mounted on the pair of racks, the carrying assembly including:

a handle coupled between an upper end of the first rack and an upper end of the second rack such that the handle bridges between the pair of racks, the handle having a pair of mounting ends, each of the mounting ends having a clasp ring;

a shoulder harness removably coupled to the clasp rings; and a securement assembly coupled to the rack for encompassing a pair of in-line skates and securing the same to the rack with the wheels of the skates situated in the recesses, the securement assembly including a flexible strap.

* * * * *